United States Patent [19]

Willis et al.

[11] 4,373,342

[45] Feb. 15, 1983

[54] COMBUSTION EQUIPMENT

[75] Inventors: Jeffrey D. Willis; Nigel P. Gibney, both of Coventry, England

[73] Assignee: Rolls-Royce Limited, London, England

[21] Appl. No.: 123,260

[22] Filed: Feb. 20, 1980

Related U.S. Application Data

[63] Continuation of Ser. No. 872,949, Jan. 26, 1978, abandoned.

[30] Foreign Application Priority Data

Feb. 4, 1977 [GB] United Kingdom ..... 4558/77

[51] Int. Cl.[3] ..... F23R 3/14

[52] U.S. Cl. ..... 60/748; 60/738

[58] Field of Search ..... 60/748, 737, 738; 239/400, 405, 406

[56] References Cited

U.S. PATENT DOCUMENTS

| | | | |
|---|---|---|---|
| 2,517,015 | 8/1950 | Mock et al. | 60/748 |
| 3,385,055 | 5/1968 | Koblish et al. | 60/748 |
| 3,403,510 | 10/1968 | Lauck | 60/748 |
| 3,430,443 | 3/1969 | Richardson et al. | 60/738 |
| 3,703,259 | 11/1972 | Sturgess et al. | 239/400 |
| 3,735,930 | 5/1973 | Mori | 239/406 |
| 3,768,250 | 10/1973 | Kawaguchi | 60/748 |
| 3,901,446 | 8/1975 | Petreikis | 60/748 |
| 3,946,552 | 3/1976 | Weinstein et al. | 60/748 |
| 4,044,553 | 8/1977 | Vaught | 60/748 |
| 4,237,694 | 12/1980 | Wood et al. | 60/738 |

FOREIGN PATENT DOCUMENTS

| | | | |
|---|---|---|---|
| 362883 | 8/1962 | Switzerland | 60/748 |
| 623772 | 5/1949 | United Kingdom . | |
| 624779 | 6/1949 | United Kingdom . | |
| 662764 | 12/1951 | United Kingdom . | |

*Primary Examiner*—Robert E. Garrett

*Attorney, Agent, or Firm*—Cushman, Darby & Cushman

[57] ABSTRACT

A gas turbine engine combustion chamber includes an inlet through which primary air can flow and which is capable of receiving a fuel injector. A cylindrical collar extends from this inlet into the interior of the combustion chamber and the collar may be parallel walled or slightly divergent and one or more rows of equi-spaced apertures can be provided in the collar wall. The presence of the collar has the effect of reducing the rate of carbon deposition on the combustion chamber head and of reducing the levels of emitted smoke.

2 Claims, 7 Drawing Figures

COMBUSTION EQUIPMENT

This is a continuation, of application Ser. No. 872,949 filed Jan. 26, 1978 now abandoned.

This invention relates to combustion equipment, for example the combustion equipment of gas turbine engines, and is particularly concerned with the problem of carbon deposition in such combustion equipment.

In some circumstances, carbon is deposited on the combustion chamber head and lumps of carbon eventually become dislodged causing considerable damage to downstream parts of the engine such as the high pressure turbine blades. It is an object of the invention to provide an improved apparatus which will at least partially prevent such carbon deposition. The present invention provides, a gas turbine engine combustion chamber having a fuel and air inlet means and a collar extending from the fuel and air inlet means into the combustion chamber, the collar being cylindrical in cross-section.

The collar may be parallel walled or divergent over the whole of its length and may be plain or be provided with one or two rows of equi-spaced radially extending holes.

Figures 1, 2:
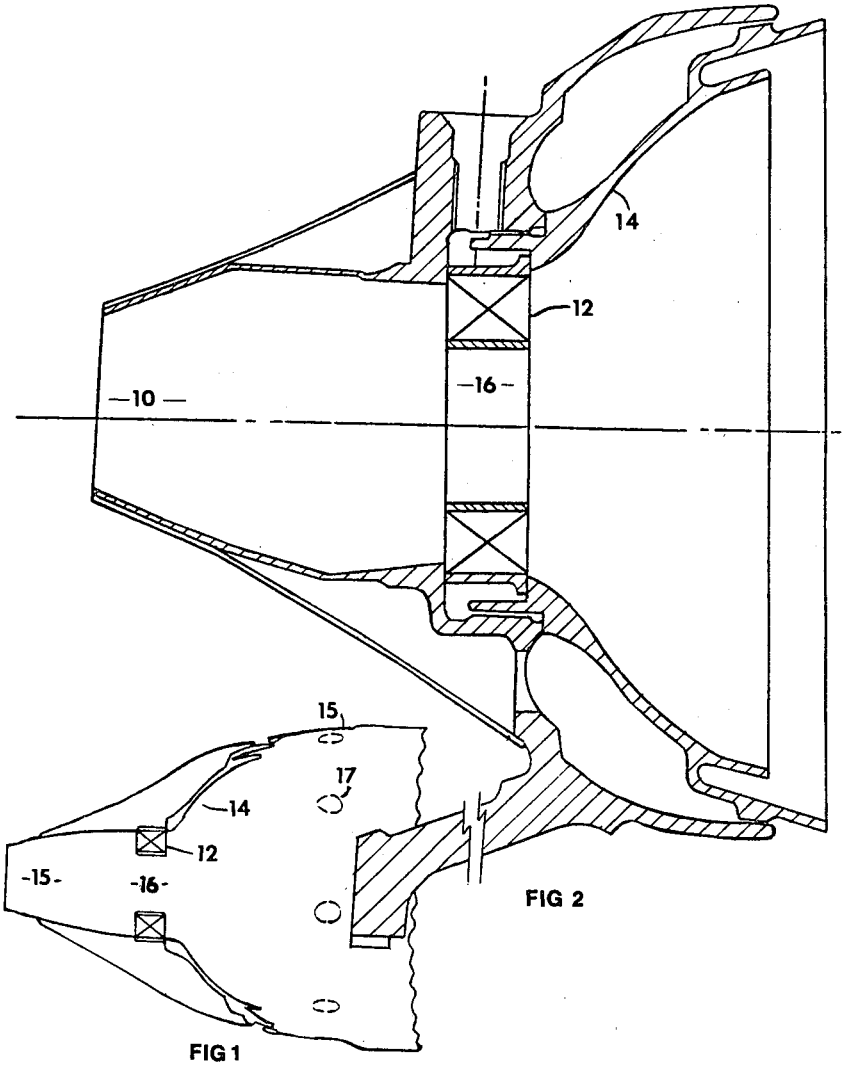
Figure 3:
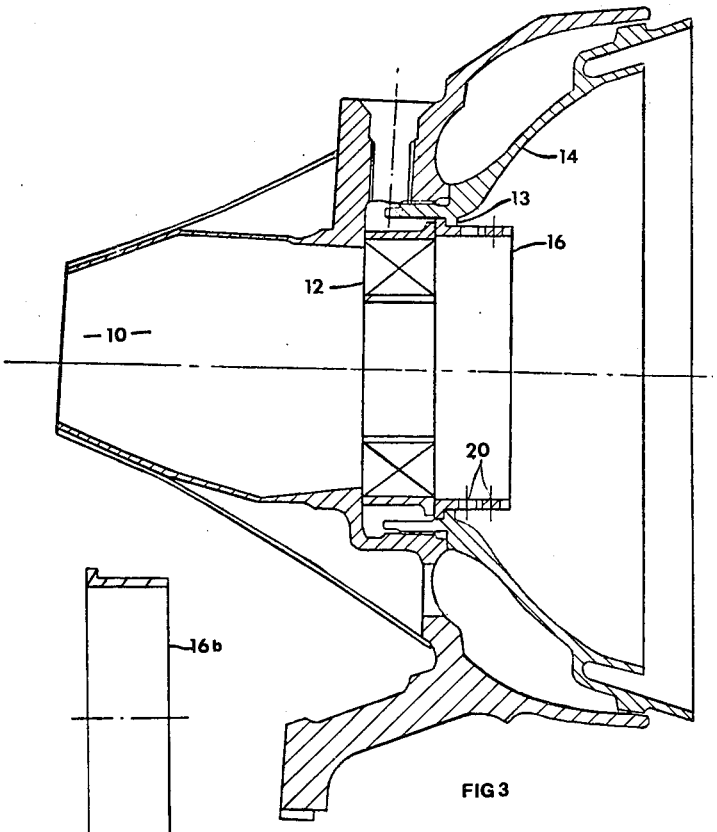
Figure 5:
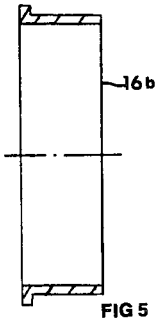
Figure 4:
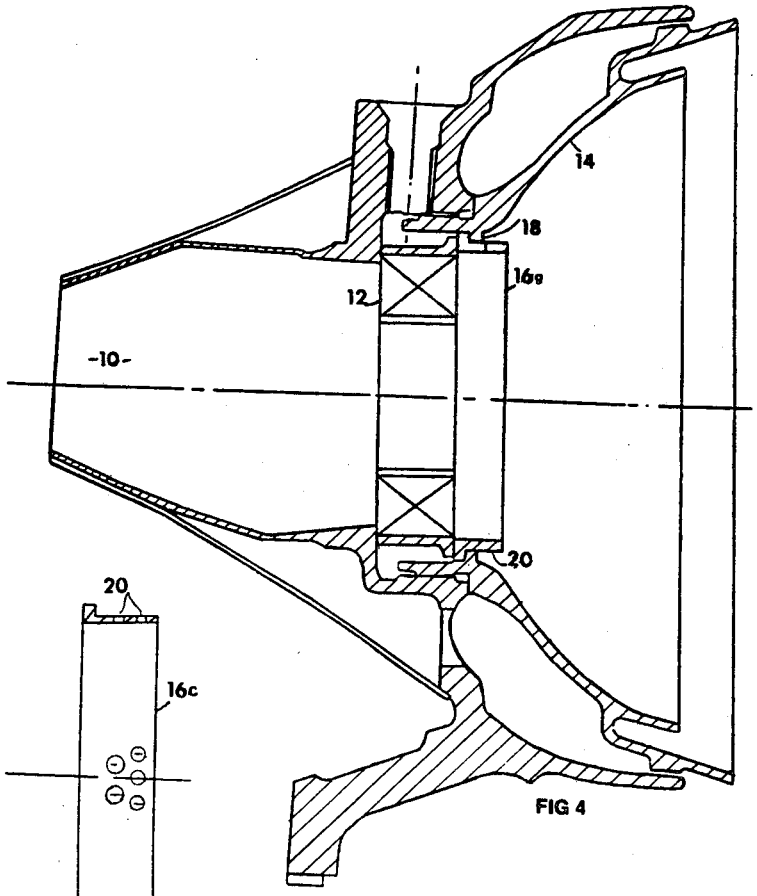
Figure 6:
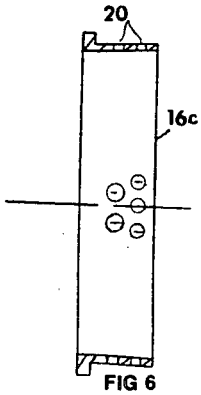
Figure 7:
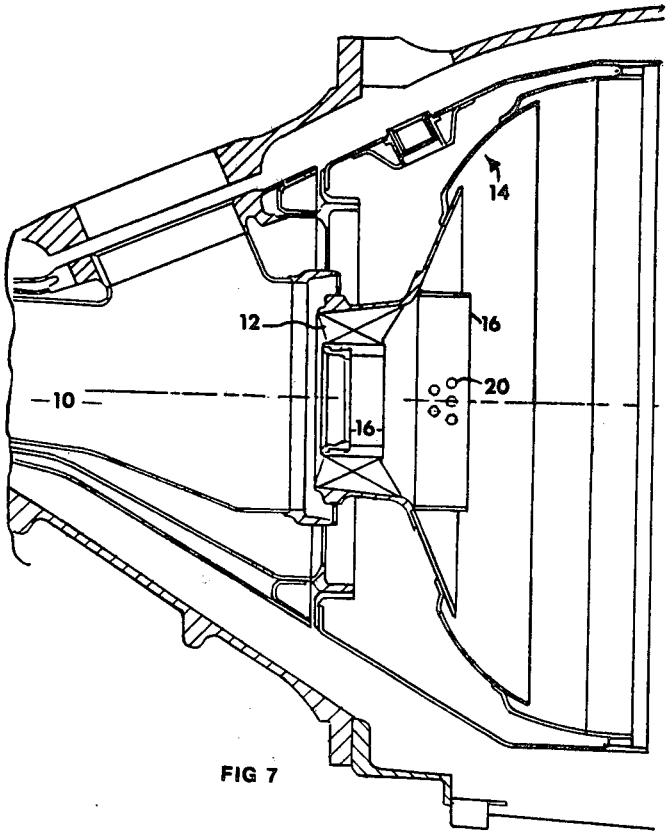

The present invention will now be more particularly described with reference to the accompanying drawings in which:

FIG. 1 shows a part elevation of a known type of combustion chamber head,

FIG. 2 shows a part-section to a larger scale through the combustion chamber head shown in FIG. 1, FIG. 3 shows a part-section through a combustion chamber head incorporating one form of the present invention, FIG. 4 shows a part-section through a combustion chamber head incorporating a further form of the present invention, FIG. 5 shows a section of a modified form of the present invention, FIG. 6 shows a section through a further modified form of the present invention and FIG. 7 shows a part section through a further combustion chamber head incorporating the present invention.

Referring to the Figs. in FIGS. 1 and 2 there is shown the upstream portion of part of the combustion equipment of a gas turbine engine (not shown). The portion comprises a compressed air inlet duct 10 which receives air from the compressor of the engine, a swirler vane assembly 12, a combustion chamber head 14 and a flame tube 15 with dilution air holes 17. The swirler vane assembly 12 surrounds a central aperture 16 in which a fuel nozzle (not shown) can be fitted. It has been found that, in operation, with this type of combustion equipment using diesel fuel, there is an accretion of carbon on the head 14. Eventually, parts of the carbon layer become detached from the head and impinge upon downstream parts of the engine, e.g. the rotating turbine blades, at a considerable velocity, causing damage. The embodiments of the invention shown in FIGS. 3 and 4 have been found to prevent or substantially reduce the carbon accretion and will now be described in more detail.

In FIG. 3, a cylindrical parallel-walled collar 16 is secured between the swirler vane assembly 12 and a flange 18 on the combustion chamber head 14. The collar 16 extends into the combustion chamber and is provided with two rows of radially extending apertures 20, the lands between the apertures being approximately equal to the aperture diameters.

Experiments have shown that with the arrangement in FIGS. 1 and 2, the primary air from the swirler vane assembly remains attached to the surface of the head 14 and the flame tube 15 until a point downstream of the dilution air holes 17 and there is evidence of relatively poor swirl and mixing in the primary zone of the combustion equipment.

With the arrangement shown in FIG. 3, the maximum swirl concentration is no longer attached to the surface of the head and flame tube and the recirculation and mixing within the primary zone is considerably improved. Most of the secondary air entering the flame tube through holes 17 passes downstream, but the secondary air which recirculates passes along the flame tube centre line.

In FIG. 4, the cylindrical parallel-walled collar **16*a* is similar to that shown in FIG. 3 except that it is shorter and has only one row of radially extending apertures 20**. With this collar, the maximum swirl concentration does remain attached to the surface of the head and flame tube but there is a strong recirculation and good mixing. The majority of the secondary air is returned to the primary zone after penetrating to the centre of the flame tube.

In FIG. 5, the cylindrical parallel-walled collar **16*b* is the same length as the collar shown in FIG. 3, but no apertures 20** are provided.

In FIG. 6, the cylindrical collar **16*e*** is no longer parallel-walled but has a slight divergence, the invention not being limited to parallel-walled collars.

FIG. 7 shows the application of the present invention to a further form of combustion chamber, the collar 16 instead of being clamped into position, as in the previous embodiments is brazed into position.

The axial length of the collar in each embodiment will vary according to the particular combustion chamber to which the collar is to be applied and is determined by seeking a compromise between emitted smoke levels and combustion efficiency. It has been found that as the collar length increases emitted smoke levels fall but combustion efficiency also decreases. Thus, if the collar is too short, combustion efficiency is good but emitted smoke levels are too high and if the collar is too long, the emitted smoke levels are good but combustion efficiency is bad. The optimum length of the collar is that which produces both acceptable combustion efficiency and emitted smoke levels.

With all the configurations of collars shown in FIGS. 3, 4, 5, 6 & 7, the accretion of carbon on the head 14 has either been prevented or considerably reduced, in addition to which less smoke is produced because of improved primary zone mixing and the weak extinction properties are improved.

Although the invention is primarily intended for diesel fuelled gas turbine engines it can also be used advantageously with kerosene and crude fuelled engines.

We claim:

1. A gas turbine engine combustion chamber comprising:

a flame tube having a dome-shaped head portion provided with a central circular aperture from which said head portion immediately diverges downstream, said tube also having secondary air inlet apertures downstream of said head portion;

a swirler vane assembly mounted in and extending upstream of said central aperture, said assembly having spaced coaxial inner and outer annular sleeves with a ring of swirl vanes extending therebetween, said sleeves forming a single annular passage for the through flow of air into said tube, said inner sleeve being adapted to have a fuel nozzle fitted therein, and the diameter of the downstream edge of said outer sleeve being generally the same as that of said aperture; and a cylindrical collar of substantially uniform diameter and substantially unobstructed interiorly throughout its length, said diameter being generally the same as that of said aperture, said collar being attached to said head portion and extending coaxially with and from said aperture into said flame tube, whereby in operation carbon accretion on the inner surface of said head portion is reduced substantially, recirculation and mixing of air and fuel is improved in the primary combustion zone upstream of said secondary air inlet apertures and weak flame extinction properties are improved.

2. The structure defined in claim 1 in which the collar is provided with a plurality of circumferentially arranged equi-spaced apertures.

* * * * *